US006568059B2

(12) United States Patent
Bush

(10) Patent No.: US 6,568,059 B2
(45) Date of Patent: May 27, 2003

(54) TREADLE VALVE VISE WITH ROTATABLE COUPLINGS

(76) Inventor: Rickie Lane Bush, 102 Elm St., Deer Park, TX (US) 77536

( * ) Notice: Subject to any disclaimer, the term of this patent is extended or adjusted under 35 U.S.C. 154(b) by 0 days.

(21) Appl. No.: 09/866,486

(22) Filed: May 24, 2001

(65) Prior Publication Data

US 2002/0174530 A1 Nov. 28, 2002

(51) Int. Cl.[7] ..... B25B 27/14

(52) U.S. Cl. ..... 29/281.4; 29/890.121; 29/402.08; 269/43; 269/69; 269/7; 269/909

(58) Field of Search ..... 29/890.121, 213.1, 29/281.1, 281.4, 464, 402.08; 269/9, 43, 69, 55, 74, 37, 40, 42, 50, 329, 909, 63, 17, 95, 88, 152; 248/676

(56) References Cited

U.S. PATENT DOCUMENTS

| | | | | | |
|---|---|---|---|---|---|
| 242,959 | A | * | 6/1881 | Naglee | 269/156 |
| 1,125,253 | A | * | 1/1915 | Barber | 29/256 |
| 1,208,522 | A | * | 12/1916 | Duncan | 269/9 |
| 1,410,184 | A | * | 3/1922 | Hunter | 269/73 |
| 1,515,915 | A | * | 11/1924 | Valenta | 219/158 |
| 1,556,882 | A | * | 10/1925 | Weaver | 29/259 |
| 1,834,294 | A | * | 12/1931 | Spahn | 269/51 |
| 1,973,238 | A | * | 9/1934 | Walter | 269/101 |
| 2,459,080 | A | * | 1/1949 | Killius | 269/71 |
| 2,654,147 | A | * | 10/1953 | Wilson et al. | 269/70 |
| 2,778,393 | A | * | 1/1957 | Golasowski | 269/63 |
| 2,814,099 | A | * | 11/1957 | Knittel | 269/17 |
| 2,827,690 | A | * | 3/1958 | Brown | 269/17 |
| 2,963,946 | A | * | 12/1960 | Muench | 269/58 |
| 2,991,669 | A | * | 7/1961 | Stock | 269/154 |
| 3,218,056 | A | * | 11/1965 | Kaplan et al. | 269/61 |
| 3,667,128 | A | * | 6/1972 | Morgan | 33/529 |
| 3,751,027 | A | * | 8/1973 | Giles | 269/152 |
| 3,770,259 | A | * | 11/1973 | Wagreich | 269/21 |
| 3,861,662 | A | * | 1/1975 | Morse | 269/17 |
| 3,895,789 | A | * | 7/1975 | Mengeringhausen et al. | 269/49 |
| 4,145,006 | A | * | 3/1979 | Webb | 269/69 |
| 4,183,511 | A | * | 1/1980 | Marek | 269/17 |
| 4,239,196 | A | * | 12/1980 | Hanger | 269/17 |
| 4,487,404 | A | * | 12/1984 | Martinez | 269/15 |
| 4,607,829 | A | * | 8/1986 | Suska | 269/88 |
| 4,676,491 | A | * | 6/1987 | Radlof | 269/296 |
| 4,691,907 | A | * | 9/1987 | Yang | 269/152 |
| 4,705,264 | A | * | 11/1987 | Hawkins et al. | 269/17 |
| 5,667,207 | A | * | 9/1997 | Pistole | 144/286.1 |
| 6,079,702 | A | * | 6/2000 | MacDonald | 269/102 |
| 6,322,061 | B1 | * | 11/2001 | Maser et al. | 269/17 |
| 6,367,789 | B1 | * | 4/2002 | Bernhardt et al. | 188/80 |

* cited by examiner

*Primary Examiner*—David P. Bryant
(74) *Attorney, Agent, or Firm*—Patrick K. Steele; Streets & Steele

(57) ABSTRACT

A tool and a method for replacing brake system components for automotive vehicles. The tool is designed to rotatably secure a worn or defective treadle valve side by side with a rotatably secured replacement treadle valve. The treadle valves can be rotated and locked into place to present corresponding faces to the user. The tool and method allows the user to measure the orientation or alignment of threaded fittings on the worn or defective treadle valve, remove them and then install them or their replacement fittings on the replacement treadle valve in the same general orientation or alignment as the fittings had on the worn or defective treadle valve. The tool and method ensures that when the replacement treadle valve is reinstalled on the vehicle, the threaded couplings on the ends of lengths of tubing will align with the fittings installed on the replacement treadle valve.

15 Claims, 4 Drawing Sheets

TREADLE VALVE VISE WITH ROTATABLE COUPLINGS

FIELD OF THE INVENTION

The present invention relates to a tool and a method for replacing brake system components for automotive vehicles. Specifically, the present invention relates to a tool and a method for achieving proper orientation and alignment of fittings when installed on a replacement treadle valve so that the fittings align and couple with multiple tubing connections on the vehicle upon installation of the replacement treadle valve.

BACKGROUND OF THE RELATED ART

Automotive braking systems, especially the type commonly used on trucks and heavy equipment, often use pressurized air or hydraulic fluid as a working fluid. Some braking systems provide a centralized source of pressurized air connected through tubing to two or more brake cylinders, usually one brake cylinder located at each wheel of the vehicle. Each brake cylinder is adapted to receive air pressure from the centralized source and apply it to actuate the brake cylinder thereby resisting or stopping rotation of the adjacent wheel. A treadle valve, or "foot valve", is operated by application of force to a brake pedal that is coupled to and operates the treadle valve to controllably distribute air pressure from the centralized source to each brake cylinder. The treadle valve has a mounting flange to facilitate securing the treadle valve to the vehicle. Each brake cylinder is usually biased toward its original, disengaged position by a return spring or an opposing return cylinder for returning the brake cylinder to its original disengaged position after the brake pedal is released. The distribution of air pressure from the centralized source to the treadle valve, and from the treadle valve to the brake cylinders, is accomplished using tubing with threaded, airtight couplings at the treadle valve, centralized source and brake cylinders. Tubing may be made of metal, nylon, plastic, rubber or other materials that are well suited for supplying or delivering pressurized air because it can be shaped, bent and manipulated to conform to available surfaces of the vehicle, it is strong, relatively inexpensive and corrosion resistant. Treadle valves usually receive air from the centralized source through multiple air supply lines of tubing and distribute air to brake cylinders through multiple delivery lines of tubing.

The use of tubing to route air pressure from the centralized source to the treadle valve and distribute on to the brake cylinders also has its disadvantages. Many types of tubing used for delivering pressurized air are not very flexible and may easily kink or collapse if overstressed while bending. When the lengths of tubing and the treadle valve with fittings are originally installed, the lengths of tubing are coupled to the treadle valve and bent and aligned as necessary to allow proper make-up of the the fittings threadably inserted into the treadle valve to the tubing. Once installed, anchored to the vehicle frame or chassis and threadably coupled at its ends to the brake cylinder and the treadle valve, a length of tubing becomes very difficult to bend, redirect or manipulate during removal or replacement of the treadle valve. This problem is compounded by the use of pressure fittings or "elbows" that are used to couple the ends of the tubing to the treadle valve. Each fitting has a threaded male end for coupling to threaded ports in the treadle valve body, and a threaded female port, usually at a 90-degree angle with the threaded male end, for receiving the seal nut on the end of the length of tubing. In addition to the angle of the fitting itself, the angular orientation of the female port of the fitting, and consequently that of the mating end of the tubing, depends on how far the threaded male end of the fitting is threaded into the port in the treadle valve body. When a worn or defective treadle valve requires replacement, the defective treadle valve is unbolted at its mounting flange from its fixed location near the brake pedal, and the ends of the lengths of tubing are disconnected from the fittings in the treadle valve body by reversing the threaded male seal nuts out of the threaded female ports in the fittings. After removal of the worn or defective treadle valve with fittings still intact, the fittings must each be removed from the worn or defective treadle valve body and each fitting, or new fitting, must then be threaded into the replacement treadle valve body prior to its installation on the vehicle. Since the inflexible tubing is difficult to bend and manipulate, replacement of a worn or defective treadle valve becomes problematic. In order to minimize bending and manipulation of tubing, it is important that each fitting be threaded into the replacement treadle valve body so that it provides the same position and angular orientation for receiving the threaded male seal nut as it previously had on the worn or defective treadle valve that is replaced. After the treadle valve is decoupled from up to eight or more lengths of tubing (e.g., four providing air pressure from the centralized source to the treadle valve and four providing air pressure from the treadle valve to the brake cylinders upon braking), great care must be taken in removing the fittings from the worn or defective treadle valve and installing them or their replacements in their corresponding coupled positions relative to the replacement treadle valve. If the threaded male end of each fitting is not threaded into its port in the treadle valve body to achieve its prior angular orientation, an attempt to bend and align the end of the tubing with the fitting after installation of the replacement treadle valve may result in tubing kinks or collapse, requiring costly and time-consuming replacement of the tubing.

There is a need for a tool that facilitates the replacement of the treadle valve with each fitting threaded into the corresponding port of the replacement treadle valve in exactly the same orientation and alignment as they previously had on the worn or defective treadle valve. There is a further need for a tool that facilitates proper orientation and alignment of fittings installed on a replacement treadle valve in order to prevent damage during coupling to tubing upon installation of the treadle valve. There is a need for a tool that enables the user to properly orient and align fittings on a replacement treadle valve in their permanent positions before the replacement treadle valve is installed on the vehicle. There is a need for a method of removing a fitting from a worn or defective treadle valve and installing it in its previous orientation and alignment on the replacement treadle valve. This tool may be used with a gauge that measures angular orientation of each fitting before the fitting is removed from the worn or defective treadle valve that is being replaced so that the fitting can be oriented and aligned in the same position when it is subsequently installed on the replacement treadle valve before the replacement treadle valve is installed on the vehicle. It is desirable that the tool of the present invention be easily used by mechanics with equipment commonly found in repair shops. It is also desirable that such a tool be designed for use with a common bench vise.

It is desirable that the tool be ergonomically designed to facilitate easy removal of the fittings from the worn or defective treadle valve and easy installation with proper orientation and alignment on the replacement treadle valve. It is desirable that the tool of the present invention be designed so that the worn or defective treadle valve and the replacement treadle valve can be mounted on the tool side by side to facilitate transfer of fittings from the worn or defective treadle valve to the replacement treadle valve, and to ensure that fittings of differing configurations are properly transferred to installed in the corresponding port of the replacement treadle valve. It is desirable that the tool of the present invention allows both the worn or defective treadle valve and the replacement treadle valve to generally be rotated about their central axes so that fittings threaded into ports located at various positions around the body of the treadle valve can be easily measured, removed, re-installed and properly aligned in the corresponding ports on the replacement treadle valve.

SUMMARY OF THE INVENTION

The present invention is a treadle valve vise having two rotatable couplings, each rotatable coupling having a means for securing a treadle valve to the rotatable coupling. These rotatable couplings may be rotatively coupled to a fixed support member that can be mounted in a common bench vise.

The two rotatable couplings each rotate about an axis, and the axis about which the first rotatable coupling rotates is generally parallel to the axis about which the second rotatable coupling rotates. The rotatable coupling may be comprised of a rotatable inner shaft that is received within and rotates within the hollow interior of a stationary pipe that is secured to a support member. The stationary outer pipe of the rotatable coupling may be circumferentially welded to a plate to provide the necessary structural support for the two rotatable couplings. The rotatable coupling is coupled to the rotatable inner shaft so that the treadle valve, when secured to the rotatable coupling, can be easily rotated for providing ready access for removal of the fittings from the worn or defective treadle valve and installation of fittings in the corresponding ports in the replacement treadle valve. The inner, rotatable shaft may be held axially in place by a retainer cap welded to the end of the inner rotatable shaft at the end of the rotatable shaft opposite the rotatable coupling.

The present invention also comprises one or more locking systems that rotatively lock each rotatable coupling in place to prevent rotation of the rotatable coupling while the user secures the treadle valves to the rotatable coupling, measures the alignment or orientation of the fittings on the worn or defective treadle valve, or removes and transfers fittings from the worn or defective treadle valve to the replacement treadle valve. The locking system may be a locking pin that is inserted through aligned pin holes in the inner rotatatable shaft and the outer stationary pipe. When the locking pin is inserted through the aligned holes in the concentric shaft and pipe, the inner shaft is rotatively locked into place until the locking pin is removed. When the locking pin is removed, the treadle valves can be further rotated for measurement, removal or reinstallation of other fittings.

The present invention provides a method of replacing a treadle valve comprising decoupling of all lengths of tubing from the fittings of the worn or defective treadle valve and securing the worn or defective treadle valve and the replacement treadle valve on rotatable couplings, one adjacent and generally parallel to the other. The treadle valves can then be rotated side by side such that the worn or defective treadle valve and the replacement treadle valve are always rotatively positioned to present corresponding sides of the two treadle valves to the user. The user can then measure the position of each fitting, remove the fitting from the worn or defective treadle valve and install the fitting or its replacement in the same orientation on the replacement treadle valve. After all fittings have been installed or replaced on the replacement treadle valve in their proper orientation and alignment, the replacement treadle valve is decoupled from the rotatable coupling, installed on the vehicle and easily coupled to lengths of tubing without kinking or collapse of tubing. It should be noted that an adjustable sliding T-bevel can be used to measure the angle of a fitting prior to its removal from the worn or defective treadle valve in order to ensure proper orientation and alignment after transfer to the replacement treadle valve.

BRIEF DESCRIPTION OF THE DRAWINGS

So that the features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not be considered limiting of its scope, for the invention may admit to other equally effective embodiments.

DETAILED DESCRIPTION OF THE INVENTION

The term "fittings" as used herein includes, but is not limited to, threaded articles adapted for sealably coupling one structure to another structure. The term "coupling" as used herein includes, but is not limited to, any mechanical connection using threads, fasteners, clips, tongue and groove, keys, slots, welds, brazing, soldering, adhesive and magnetic bonding. The term "vise" as used herein includes, but is not limited to, any device for holding or securing an object so that it can be manipulated or worked on. The term "shaft" as used herein includes any generally symmetrical and rotatable structure suitable for rotation including, but not limited to, an axle, rod, stem, pipe or tube.

Figure 1:
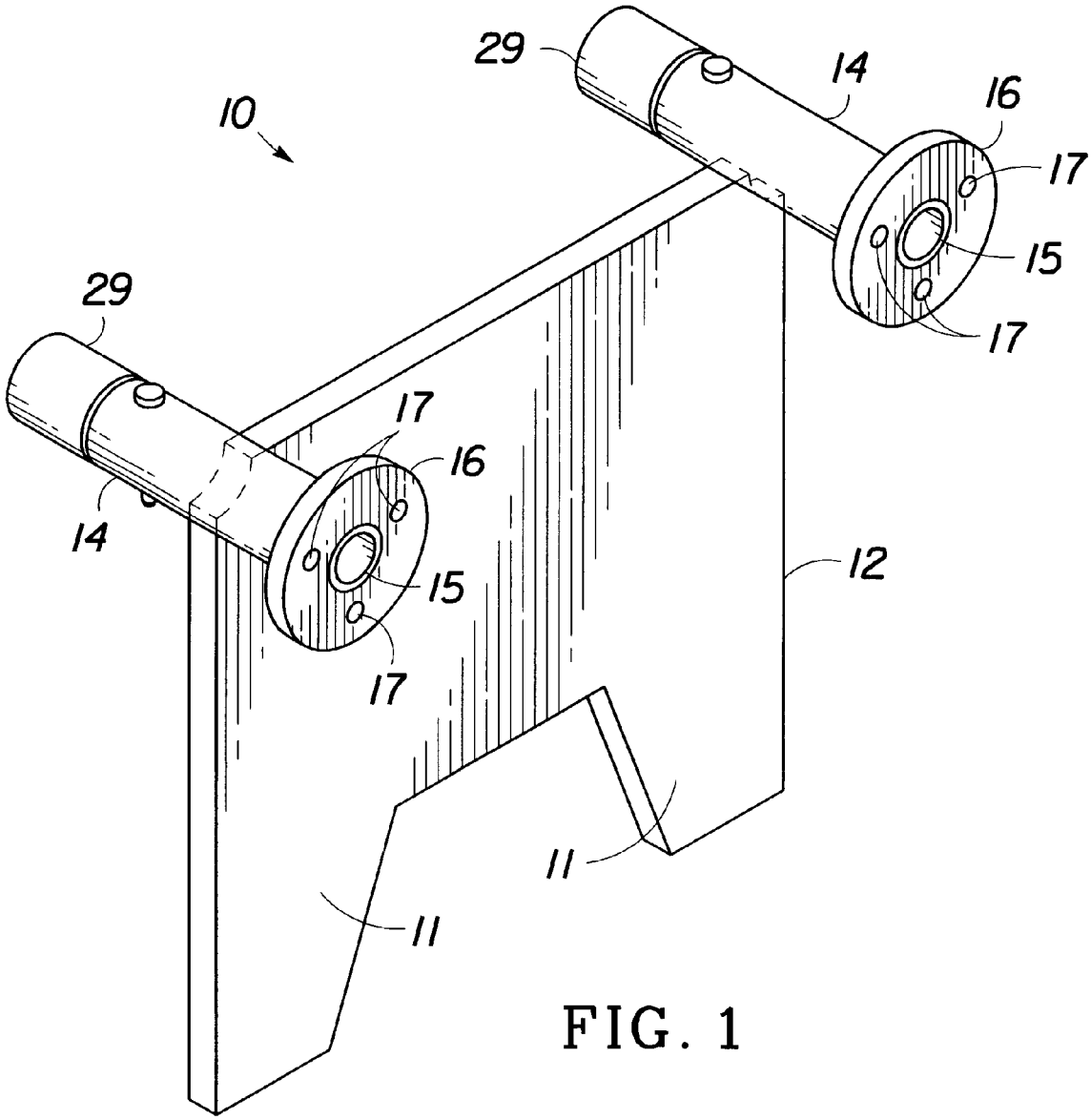
FIG. 1 is a perspective view of the preferred embodiment of the treadle valve vise with its side-by-side arrangement of two rotatable couplings.

FIG. 1 is a perspective view of the preferred embodiment of the treadle valve vise 10 having two generally parallel rotatable couplings 16. Each rotatable coupling may comprise a recess or hollow interior near its center for accommodating a protrusion of the treadle valve that is generally central to the mounting surface of the treadle valve and receives controlling input to operate the treadle valve. Plate 12 provides structural support for the rotatable couplings 16 and can be made of any material that can support the rotatable couplings with the treadle valves secured thereto, and withstand the forces applied to the rotatable couplings in the course of measuring and removing the fittings from the worn or defective treadle valve and subsequently installing the fittings or their replacements on the replacement treadle valve. In the embodiment shown in FIG. 1, a pair of opposing legs 11 is provided to adapt the treadle valve vise for being gripped in a bench vise with the legs 11 straddling the vise beam. Just as easily, however, the apparatus may be mounted on a wall or other support structure without using a bench vise.

In the embodiment shown in FIG. 1, two rotatable couplings 16 are provided for securing a worn or defective treadle valve and a replacement treadle valve in a side by side arrangement. Each rotatable coupling in FIG. 1 contains bolt holes 17 for receiving and securing the mating mounting flange on a treadle valve. However, any means for securing the treadle valves to the couplings would be acceptable including, but not limited to, fasteners, clamps, straps, magnetic couplings or even an elastic or adhesive coupling.

In the embodiment of the present invention shown in FIGS. 1 through 4, two rotatable assemblies 13 are coupled to a plate 12 at or near the top corners of the plate 12. Each rotatable assembly 13 comprises a stationary pipe 14 having a hollow interior, a rotatable shaft 15, a rotatable coupling 16 and a retainer cap 29. The rotatable shaft 15 is of sufficiently small diameter that it is received into the hollow interior of stationary pipe 14 so that the rotatable shaft 15 can rotate within the stationary pipe 14. A retainer cap 29, having at least one dimension larger than the diameter of the hollow passage through the stationary pipe 14, is coupled to the end of the rotatable shaft 15 to prevent the rotatable shaft 15 from passing beyond a certain predetermined position within the hollow interior of the stationary pipe 14. Although the retainer cap 29 is not required for functioning of the treadle valve vise 10, it serves to keep the rotatable shaft 15 in its proper position within the stationary pipe 14.

Positioning of the rotatable couplings 16 relative to the top of the plate 12 prevents interference by the plate 12 with operation of wrenches or tools used to remove or reinstall fittings in threaded ports on treadle valves secured to the rotatable couplings 16. While the preferred embodiment mounts the rotatable couplings 16 at the corners of the plate 12, the rotatable couplings 16 could be mounted at other locations on the plate 12 so long as sufficient clearance is provided for tools or wrenches used to remove or install fittings on treadle valves secured to the rotatable couplings 16. While the preferred embodiment comprises only two rotatable couplings 16, the present invention may comprise more than two rotatable couplings.

Figure 2:
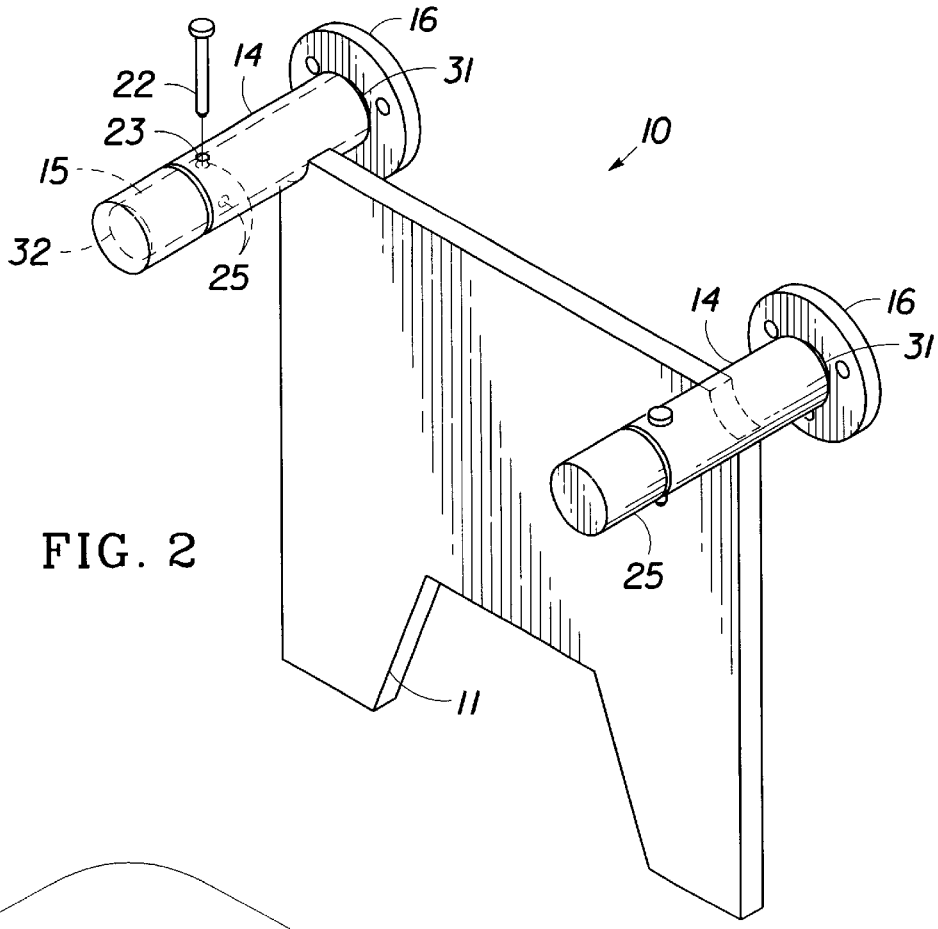
FIG. 2 is a reverse perspective view of the preferred embodiment of the treadle valve vise showing the locking mechanism used for rotatively locking the rotatable couplings.

FIG. 2 is a reverse prospective view of the preferred embodiment of the present invention showing the locking mechanism that prevents unwanted rotation of the rotatable couplings 16 during work on treadle valves secured to the rotatable couplings 16. This embodiment of the locking feature of the treadle valve vise 10 provides two aligned pin holes 23 in the stationary pipe 14 and the rotatable shaft 15 therein comprises two channels 25, one generally perpendicular to the other, and both generally perpendicular to the axis of rotation of the rotatable shaft 15. As the rotatable shaft 15 rotates 90 degrees within the stationary pipe 14, one of the channels 25 in the rotating shaft 15 aligns with the pin holes 23 in the stationary pipe 14, and locking pin 22 may be inserted through the aligned pin holes 23 and through an aligned channel 25 to rotatively lock the rotatable shaft 15 thereby allowing the user to work on treadle valves secured to the rotatable couplings 16 without unwanted rotation of the treadle valves.

Figure 3:
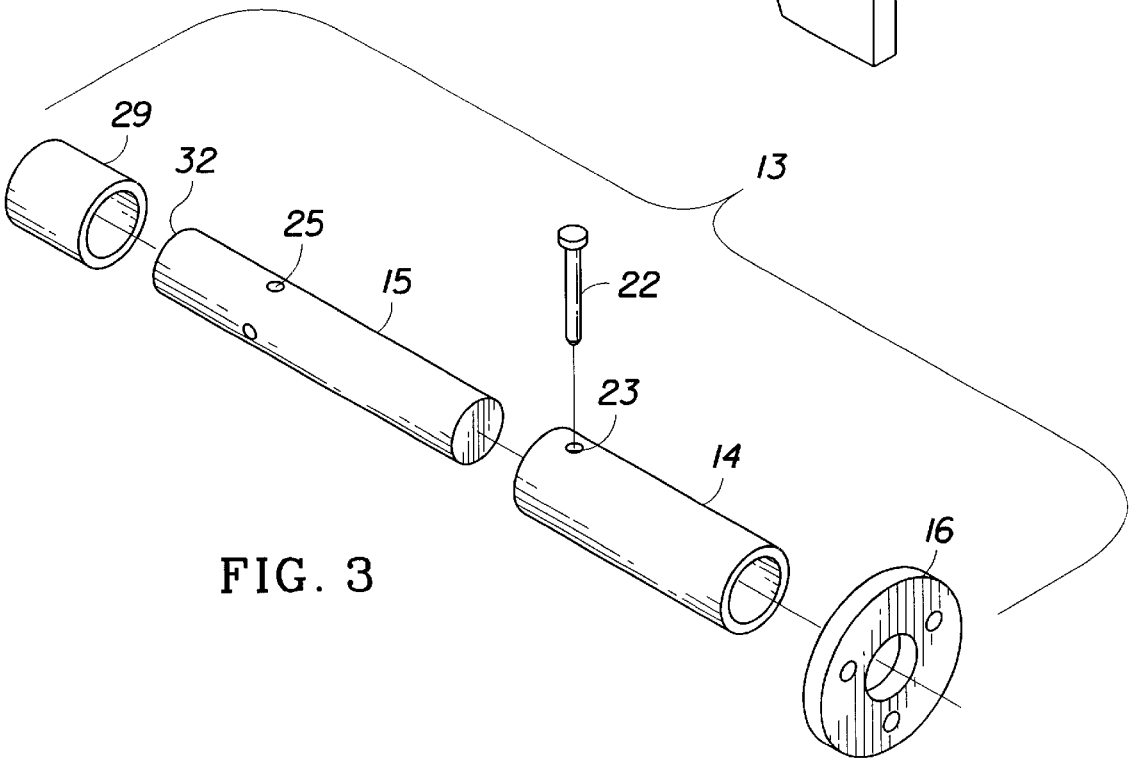
FIG. 3 is an exploded view of one of the rotatable assemblies of the preferred embodiment of the present invention.

FIG. 3 is an exploded view of one of the rotatable assemblies 13 of the treadle valve vise 10. The rotatable coupling 16 of each rotatable assembly 13 is coupled to a first end 31 of the rotatable shaft 15 and the retainer cap 29 is coupled to a second end 32 of the rotatable shaft 15. The channels 25 are disposed within the rotatable shaft 15 between the first end 31 and the second end 32. The number of channels 25 in the rotatable shaft 15 corresponds to one-half of the number of locked positions for the rotatable coupling 16. In the embodiment of the treadle valve vise 10 shown in FIGS. 1 through 4, two generally coplanar channels 25 in the rotatable shaft 15 provide a total of four rotatively locked positions of the rotatable coupling 16. The pin holes 23 in the stationary pipe 14 align with a selected channel 25 in the rotatable shaft 15 to receive a locking pin 22 thereby rotatively locking the rotatable assembly 13. The rotatable coupling 16 and the rotatable shaft 15 are thereby prevented from rotating from the selected position within the hollow interior of the stationary pipe 14. In the preferred embodiment, the retainer cap 29 is welded to the second end 32 of the rotatable shaft 15, but any means of attaching the retainer cap 29 is acceptable.

Figure 4:
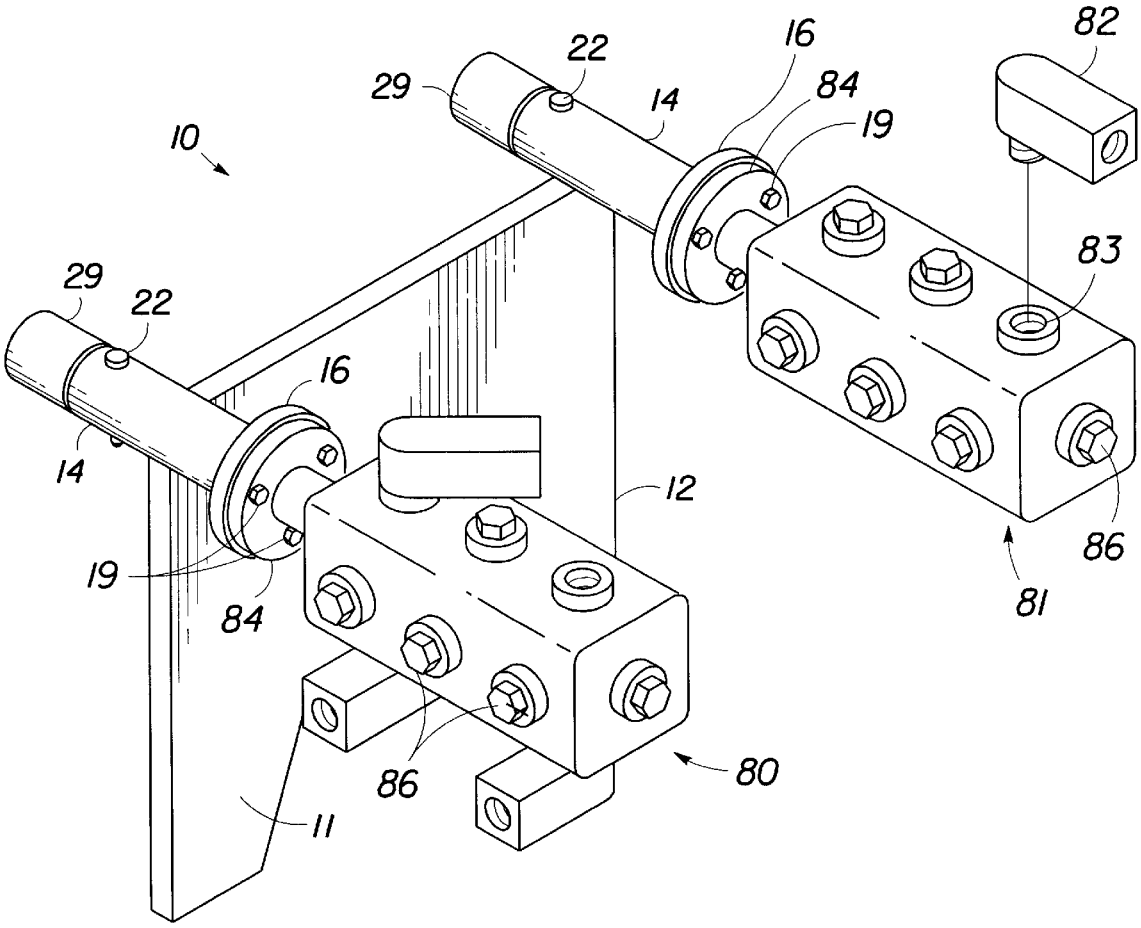
FIG. 4 is a perspective view of the preferred embodiment of the treadle valve vise showing a worn or defective treadle valve received onto one of two rotatable couplings and a replacement treadle valve received onto the other rotatable coupling.

FIG. 4 is a perspective view of the preferred embodiment of the treadle valve vise 10 with treadle valves 80 and 81 coupled to the rotatable couplings 16. While this preferred embodiment of the treadle valve vise shows treadle valves secured to the rotatable couplings 16, the treadle valve vise 10 may be used to secure articles other than treadle valves. Any article that would benefit from being rotatably secured adjacent to another rotatably secured article, each article thereby subject to being rotated and locked into selected positions thereby presenting corresponding faces to the user to facilitate work, may benefit from the use of the treadle valve vise 10. The fittings 82 threadably secured to the worn or defective treadle valve 80 maybe measured with any suitable measuring device to determine their original alignment or orientation on the worn or defective treadle valve 80. A preferred tool for measuring the original orientation and alignment of the fittings 82 on the worn or defective treadle valve is an adjustable sliding T-bevel. The fittings 82 can be measured to determine the original angle on the worn or defective treadle valve, then removed from the worn or defective the treadle valve 80 and installed in the same alignment or orientation on the replacement treadle valve 81. Alternately, the fittings may be left on the worn or defective treadle valve 80 and replacement fittings may be installed on the replacement treadle valve 81 in orientations matching those of the corresponding fittings on the worn or defective treadle valve 80. When the fittings 82 have been transferred from one face of the worn or defective treadle valve 80 to the corresponding face of the replacement treadle valve 81, or when replacement fittings have been installed, the rotatable couplings 16 are rotated to expose other faces of the worn or defective treadle valve 80 and the replacement treadle valve 81 for further measurement of fittings 82, alignment, or orientation and transfer of fittings 82 to the replacement treadle valve 81.

Figure 5:
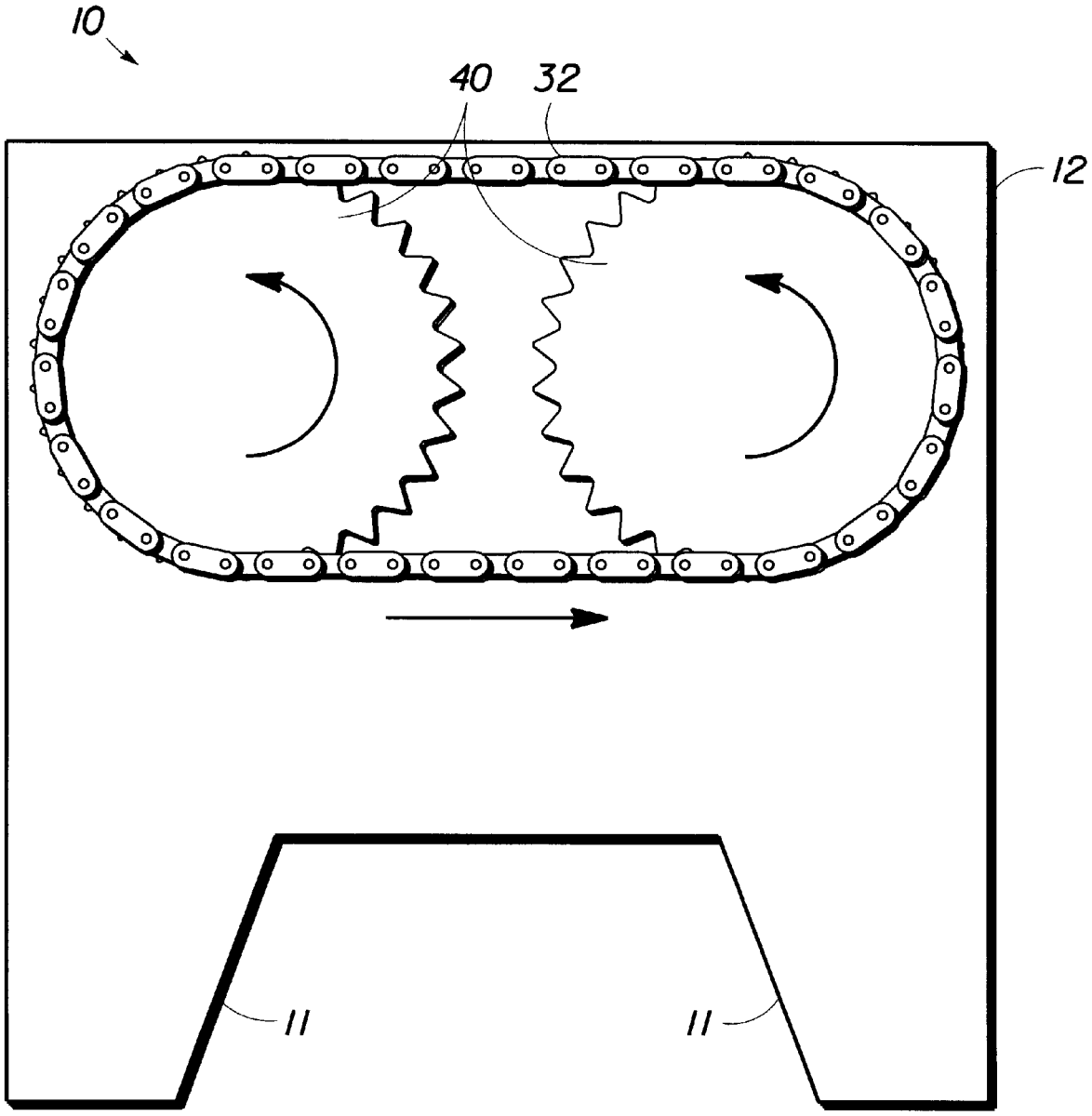
FIG. 5 shows a reverse view of an alternate embodiment of the treadle valve vise having rotatively linked rotatable couplings causing the rotatable couplings to synchronously rotate.

FIG. 5 shows a reverse view of an alternate embodiment of the treadle valve vise 10 using an alternate locking system. In this alternate embodiment, a sprocket 34 is coupled to each of the rotatable couplings 16. A linked chain 32 engages a portion of the periphery of both sprockets 34 such that the sprockets 34 and the coupled rotatable couplings 16, and the treadle valves coupled thereto, rotate synchronously whenever rotation of either of the rotatable couplings 16 occurs. By locking one rotatable assembly 13, both rotatable assemblies 13 are thereby rotatively locked due to the linking of one rotatable assembly 13 to the other.

While the foregoing is directed to the preferred embodiment of the present invention, other and further embodiments of the invention may be devised without departing from the basic scope thereof, and the scope thereof is determined by the claims that follow.

I claim:

1. An apparatus for mounting at least two articles thereto for the purpose of repair, assembly, or inspection of said articles, or a combination thereof, said apparatus comprising:

two or more substantially rotatable couplings, said couplings each including a flange thereon for respectively securing two or more articles thereto, and said couplings being coupled to a common support member; and a locking system for rotatively locking at least one of the rotatable couplings in one of at least two angular locked positions;

wherein said locking system in an engaged position maintains said rotatable couplings and the articles secured thereto in a first angular locked position such that corresponding faces of said articles are disposed in a first substantially identical orientation, and in a disengaged position permits the rotatable couplings and the articles secured thereto to be rotated to and subsequently locked in a second angular position such that corresponding faces of said articles are disposed in a second substantially identical orientation.

2. The apparatus of claim 1, wherein the support member is adapted to be gripped in a bench vise.

3. The apparatus of claim 2, further comprising two or more legs extending downwardly from the support member wherein the legs can receive a vise beam therebetween when the support member is gripped in a bench vise.

4. The apparatus of claim 1, further comprising at least two stationary pipes secured in a fixed configuration relative to a support member and substantially parallel one to the other.

5. The apparatus of claim 4, wherein the rotatable couplings are adapted for securing a treadle valve thereto using fasteners.

6. The apparatus of claim 4 wherein the rotatable couplings are each coupled to rotatable shafts, one received into each of the stationary pipes and each having a first end and a second end and being of a diameter less than the inside diameter of the stationary pipe into which it is received.

7. The apparatus of claim 6, further comprising a retainer cap for securing the rotatable shafts within the stationary pipes.

8. The apparatus of claim 6, further comprising a first sprocket and a second sprocket, each coupled to the second end of each rotatable shaft, a rotatable coupling coupled to the first end of each rotatable shaft, and a linked chain engaging a portion of the periphery of both sprockets, wherein rotation of one of the rotating couplings causes synchronous rotation of the other rotatable coupling.

9. The apparatus of claim 8, wherein the locking member comprises a hole in the plate and a plurality of holes in one of the sprocket wheels, such that a hole on the sprocket wheel can be aligned with the hole in the plate, whereby inserting a pin through the aligned holes rotatively locks the shaft into an angularly distinct position, thereby locking all the rotatable couplings into the same angularly distinct position by the chain linking them.

10. The apparatus of claim 1, wherein said flange is adapted for receiving a treadle valve.

11. The apparatus of claim 10, wherein the flange comprises a plurality of holes for insertion of bolts for securing the treadle valve to the rotatable coupling.

12. The apparatus of claim 1, wherein the locking system comprises a pair of aligned holes in a stationary pipe and at least two generally coplanar channels in a rotatable shaft, the channels having axes perpendicular to the axis of the rotatable shaft, wherein each channel is alignable with the pair of aligned holes in the stationary pipe for receiving a locking pin therethrough for rotatively locking the rotatable shaft.

13. The apparatus of claim 1, wherein the two or more articles are treadle valves.

14. The apparatus of claim 1, wherein the support member is adapted to be mounted to a wall.

15. The apparatus of claim 1, wherein the support member is adapted to be mounted to a support structure.

* * * * *